United States Patent [19]

Cova

[11] Patent Number: 4,635,425

[45] Date of Patent: Jan. 13, 1987

[54] PORTABLE AND MODULAR DANCE FLOOR

[75] Inventor: Michel Cova, Villeurbanne, France

[73] Assignee: Constructions Metalliques et Carrosseries Caire Claude, Voglans, France

[21] Appl. No.: 753,244

[22] Filed: Jul. 9, 1985

[30] Foreign Application Priority Data

Jul. 9, 1984 [FR] France ..... 84 11213

[51] Int. Cl.[4] ..... E04D 5/52

[52] U.S. Cl. ..... 52/480; 52/591; 52/793

[58] Field of Search ..... 52/589, 591, 793, 393, 52/480, 481

[56] References Cited

U.S. PATENT DOCUMENTS

| | | | |
|---|---|---|---|
| 2,189,218 | 2/1940 | Neumeister | 52/589 X |
| 2,668,991 | 2/1954 | Taphoureau | 52/589 |
| 3,619,964 | 11/1971 | Passaro et al. | 52/393 X |
| 4,160,349 | 7/1979 | DeSchutter | 52/481 |
| 4,443,989 | 4/1984 | Silvey et al. | 52/393 X |

FOREIGN PATENT DOCUMENTS

| | | | |
|---|---|---|---|
| 970083 | 12/1950 | France | 52/591 |
| 280400 | 11/1927 | United Kingdom | 52/393 |

*Primary Examiner*—Carl D. Friedman

*Attorney, Agent, or Firm*—Karl F. Ross; Herbert Dubno

[57] ABSTRACT

A portable dance floor for use on a stationary floor surface is formed of a plurality of like elements each comprising vertically spaced upper and lower similar rectangular panels having straight edges, and at least an upper and a lower set of parallel and spaced-apart sticks. The upper set is fixed to the upper panel and to the lower set and the lower set is fixed to the lower panel. In addition the sticks of the upper set are generally perpendicular to those of the lower set and both sets include two edge sticks at and generally parallel to respective opposite edges of the panels. The sticks of different elements are connected together with the respective upper panels substantially coplanar. Each set of sticks is of a predetermined thickness and extends at a small acute angle to the respective edges so that each edge stick has one end immediately juxtaposed with the respective panel edge and an opposite end spaced inward therefrom by a distance equal generally to its thickness. Thus the tangent of the angle formed between each stick and the panel edges it is generally parallel to is equal to the stick thickness divided by the length of the respective panel edge.

10 Claims, 4 Drawing Figures

PORTABLE AND MODULAR DANCE FLOOR

FIELD OF THE INVENTION

The present invention relates to a dance floor. More particularly this invention concerns such a floor which is made up of a plurality of identical and portable modules or elements so it can be used atop another floor surface not suitable for dancing on.

BACKGROUND OF THE INVENTION

Whether classical ballet or modern dance, the floor on which a performer is to dance must fulfill several rigid requirements. It must be smooth, continuous, and fairly hard, and it must be somewhat springy. This can be achieved by appropriate construction, usually of wood, in a dance studio.

Dance performances or dance practices held in areas not otherwise used for dance necessitate a temporary floor construction that must be portable. The typical such arrangement is simply a low stage formed by a plurality of elements each of whose upper surface is formed by a plywood panel which may have an individual frame. The resilience of such a construction varies perceptibly between the edge and center of each panel, and the panels often do not mate neatly and do not stay together once assembled unless screw-type clamps are employed.

It has also been suggested to use a construction of sleepers atop an elastomeric sheet and screwed to floor boards. Such a floor has been found unusable atop, for instance, a concrete floor.

OBJECTS OF THE INVENTION

It is therefore an object of the present invention to provide an improved portable dance floor.

Another object is the provision of such a portable dance floor which overcomes the above-given disadvantages, that is which can be set up rapidly without the use of fasteners and that will give good response over all parts of the dance surface it forms.

SUMMARY OF THE INVENTION

A portable dance floor for use on a stationary floor surface is formed of a plurality of like modules or elements each comprising vertically spaced upper and lower similar rectangular panels having straight edges, and at least an upper and a lower set of parallel and spaced-apart sticks. The upper set is fixed to the upper panel and to the lower set and the lower set is fixed to the lower panel. In addition the sticks of the upper set are generally perpendicular to those of the lower set and both sets include two edge sticks at and generally parallel to respective opposite edges of the panels. The sticks of different elements are connected together with the respective upper panels substantially coplanar.

The use of the sets of sticks, which in effect form a lattice sandwiched between the two panels, effectively isolates the upper panel from the lower panel while making the resultant module very stiff dimensionally. The floor is very quiet, having none of the squeaks that modular slat-type floors, as the panels according to this invention are of plywood or the like so they form a unitary and squeak-free surface. The response is virtually the same over the entire surface of the element.

According to another feature of this invention each set of sticks is of a predetermined thickness and extends at a small acute angle to the respective edges so that each edge stick has one end immediately juxtaposed with the respective panel edge and an opposite end spaced inward therefrom by a distance equal generally to its thickness. In other words, the tangent of the angle formed between each stick and the panel edges it is generally parallel to is equal to the stick thickness divided by the length of the respective panel edge.

The ends of the sticks in accordance with the invention project beyond the panels and interconnect the floor elements. The sticks of one set are perpendicular to those of the other set and the ends of each stick of each set project beyond the edge sticks of the other set by a distance equal generally to twice the stick thickness.

According to a further feature of this invention each element includes a third set of sticks between the lower set and the lower panel. Thus the lower set is fixed via the third set to the lower panel and the sticks of the third set are parallel to the sticks of the upper set. Furthermore the sticks of the upper and third sets are aligned perpendicular to the panels.

To ensure that the upper panels always butt tightly at their edges, the edges of the lower panel are slightly shorter than those of the upper panel. Furthermore each element can have four elastomeric feet fixed to the lower panel so that the element can stand via the feet on the ground surface. These feet are in alignment with the four intersections of sticks closest to the corners of the panels.

DESCRIPTION OF THE DRAWING

The above and other features and advantages will become more readily apparent from the following, reference being made to drawing in which.

SPECIFIC DESCRIPTION

Figure 1:
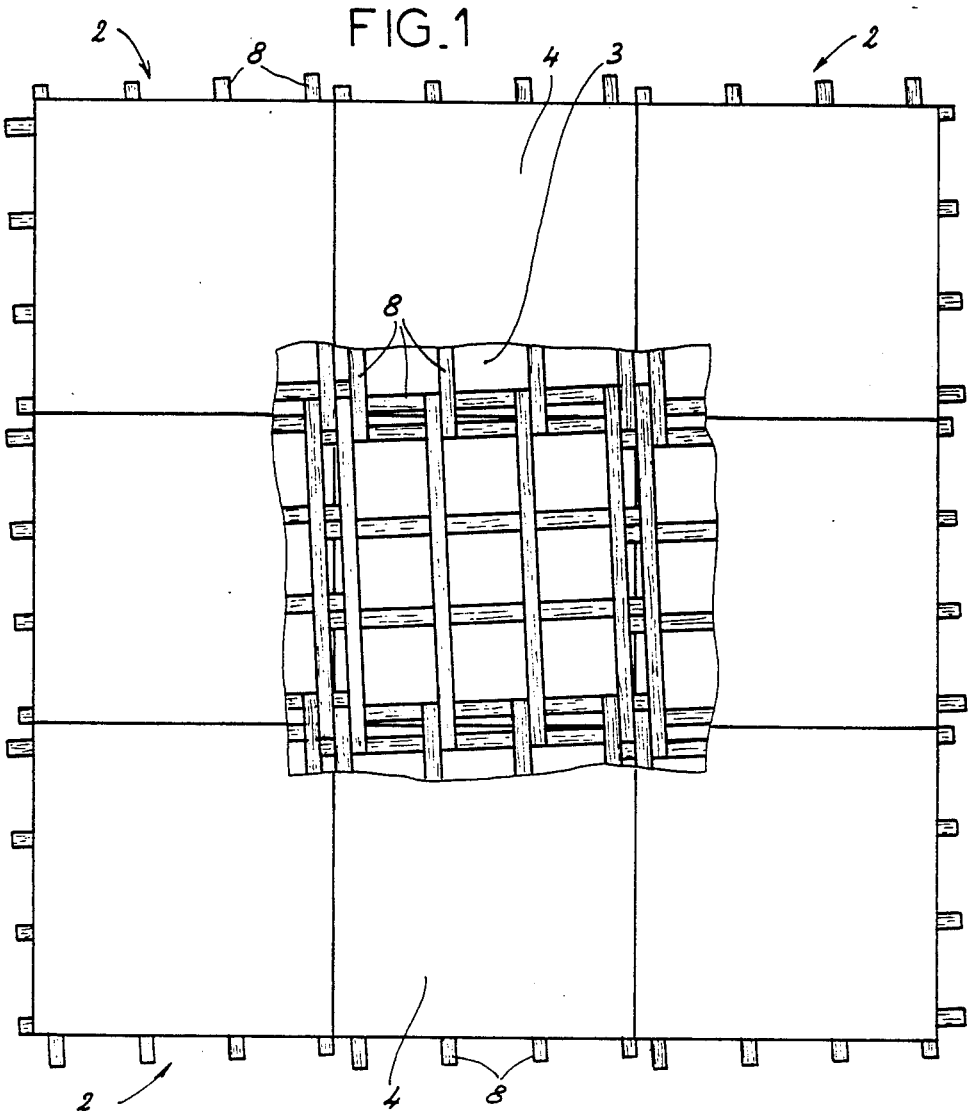
FIG. 1 is a small-scale and partly broken-away top view of the modular dance floor according to this invention.
Figure 2:
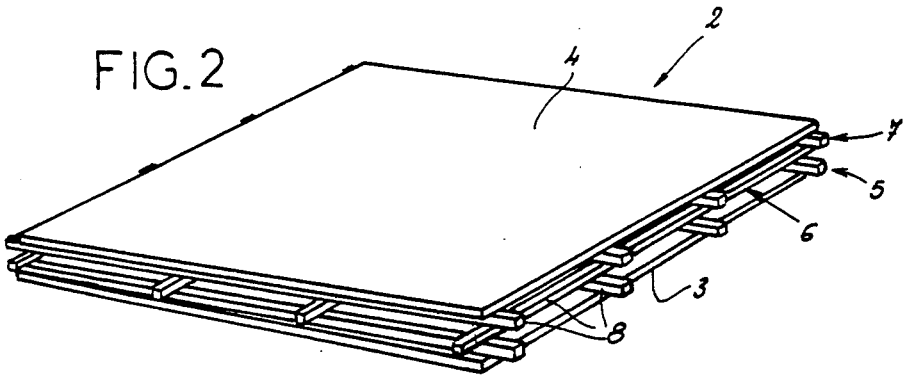
FIG. 2 is a perspective view of an element of the floor according to the invention.

As seen in FIG. 1 a modular and portable dance floor according to this invention is formed of nine identical square elements 2 each having a edge length D of 1.2 m, forming a square dance area 3.6 m on a side. As better seen in FIGS. 2 through 4, each such element 2 comprises a square lower panel 3 of plywood about 10 mm thick and slightly less than 1.2 m on a side, a square upper panel 4 of the same thickness and 1.2 m on a side, and three sets 5, 6, and 7 of square-section wooden sticks 8 each having a thickness a of 24 mm and being about 1272 mm long. Each set 5, 6, 7 comprises four such sticks 8 spaced apart by about 256 mm. The sticks 8 of the top and bottom sets 5 and 7 are parallel and perpendicular to the sticks 8 of the middle set 6. Glue and nail or screw joints secure the sticks 8 together where they cross and to the panels 3 and 4.

Adhered to the bottom surface of the lower panel 3 are four elastomeric blocks forming feet 9 that are adapted to rest on the floor surface 10. One such foot 9 is provided at each corner of each element 2, underneath the intersection of the sticks 8 closest to the respective corner.

Figure 3:
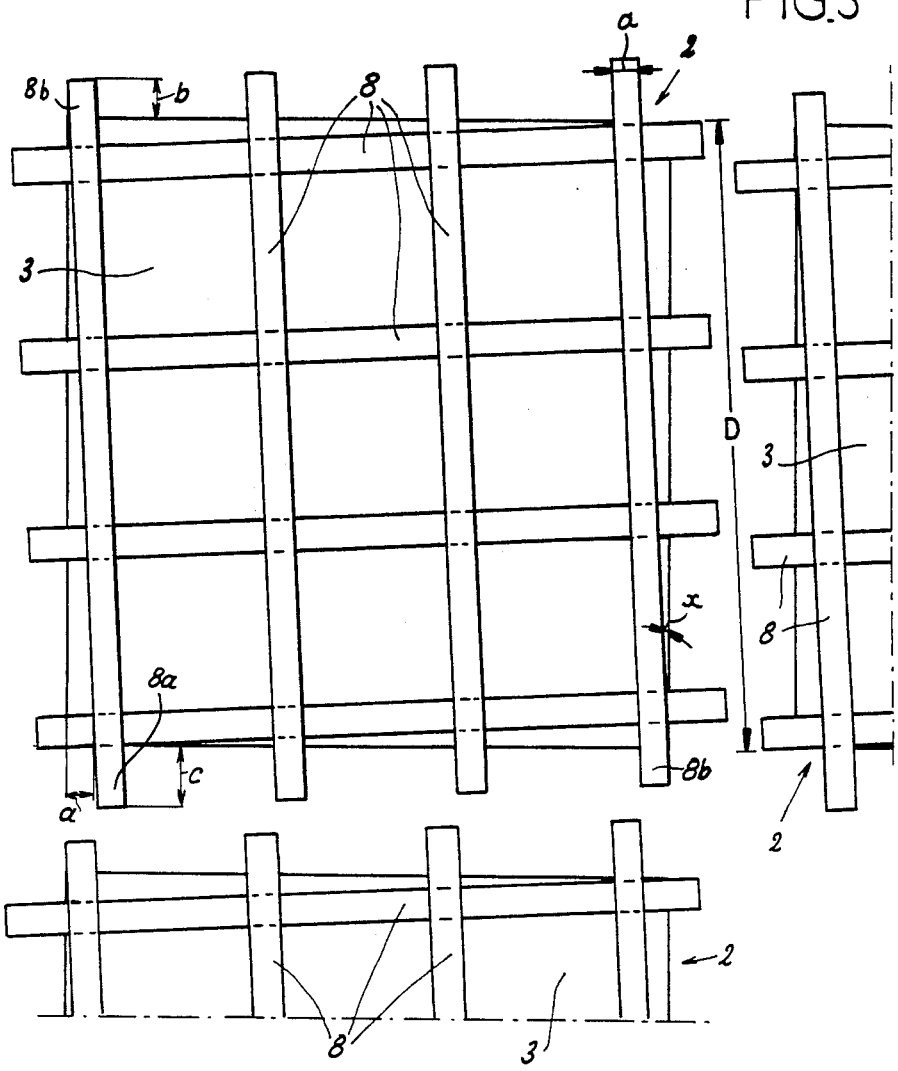
FIG. 3 is a top view of a detail of the floor during assembly and with the top panels removed for clarity of view.
Figure 4:
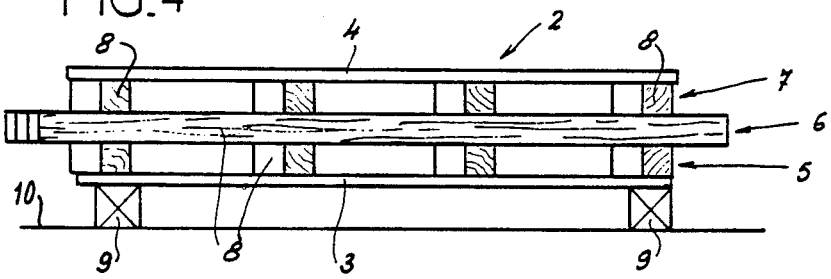
FIG. 4 is a side view of an element of the floor according to this invention.

As best seen in FIG. 3 the sticks 8 do not extend parallel to the respective edges of the panels 3 and 4, but extend at an angle x thereto which is a function of the length D of the edge of the element 2 and the thickness a of the stick 8, so that tan x=a/D. The two edge sticks 8 of each set of four each have one end immediately adjacent the respective edge of the upper panel 4, and one that projects beyond the panel 4 by a distance c equal to *2a*, here 48 mm. The opposite end of each such edge stick 8 is spaced inward by the distance a from the same panel edge, and projects beyond the panel 4 by a distance b equal to the thickness a. The sticks 8 not at the panel edges have their ends at intermediate distances between b and c so that these ends are on a line extending between the ends of the edge sticks 8.

This slight diagonality of the sticks allows the panels to fit together very neatly. The projecting end of each stick 8 will lie laterally against the projecting end of the corresponding stick 8 of the same set in the adjacent element 2. The projecting ends of the lower set 5 of sticks 8 are also engaged vertically between the adjacent lower panel 3 and the outermost stick 8 of the adjacent middle set 6, the projecting ends of the middle set 6 of sticks 8 are engaged vertically between the outermost sticks 8 of the adjacent lower and upper sets 5 and 7, and the projecting ends of the upper set 7 of sticks 8 are engaged vertically between the adjacent upper panel 3 and the outermost stick 8 of the adjacent middle set 6. At the corners all of the sticks come together to lock the elements solidly together.

Such a modular panel can be made very simply. A simple rectangular lattice comprising the three sets 5, 6, and 7 can be made up independently of the two panels 3 and 4. The stick length is simply the length D of the panel edge plus twice the stick thickness a, and the spacing between the two edge sticks of each array, that is between the far sides of the outside two sticks, is equal to the side length D minus the thickness a. This lattice 5, 6, 7 is therefore easy to design and construct. Once it is complete it is sandwiched between the two panels 3 and 4 and canted somewhat by the angle x. The panels 3 and 4 are fixed to the upper and lower surfaces of the lattice 5, 6, 7 formed by the sticks 8 and the module 2 is complete. Assembly is therefore simple and inexpensive.

The triple-layer grid or lattice formed by the sticks 8 makes a fairly springy but very strong floor structure. The springiness is essentially uniform over the entire surface, if slightly reduced directly above the feet 9. The interconnection is so solid, however, that no supplementary fasteners are needed, making it possible to set up and take down the portable floor structure according to this invention very rapidly. In addition the overlap of the stick ends that serves to secure the floor elements together also ensures that there is double support under the panel edges, protecting them and making the response of these regions stiffer, like farther in on the element.

I claim:

1. A portable dance floor for use on a stationary floor surface, the floor being formed of a plurality of like elements each comprising:

vertically spaced upper and lower similar rectangular panels having straight edges; and at least an upper and a lowe set of parallel and spaced-apart sticks, the upper set being fixed to the upper panel and to the lower set and the lower set being fixed to the lower panel, the sticks of the upper set being generally perpendicular to those of the lower set, both sets including two edge sticks at and generally parallel to respective opposite edges of the panels, the floor also comprising means for laterally connecting the sticks of different elements with the respective upper panels substantially coplanar each set of sticks being of a predetermined thickness and extending at a small acute angle to the respective edges so that each edge stick has one end immediately juxtaposed with the respective panel edge and an opposite end spaced inward therefrom by a distance equal generally to its thickness.

2. The portable dance floor defined in claim 1 wherein the ends of the sticks project beyond the panels and constitute the means.

3. The portable dance floor defined in claim 2 wherein the sticks of one set are perpendicular to those of the other set.

4. The portable dance floor defined in claim 3 wherein the ends of each stick of each set project beyond the edge sticks of the other set by a distance equal generally to twice the stick thickness.

5. The portable dance floor defined in claim 1 wherein each element includes a third set of sticks between the lower set and the lower panel, the lower set being fixed via the third set to the lower panel, the sticks of the third set being parallel to the sticks of the upper set.

6. The portable dance floor defined in claim 5 wherein the sticks of the upper and third sets are aligned perpendicular to the panels.

7. The portable dance floor defined in claim 1 wherein the edges of the lower panel are slightly shorter than those of the upper panel.

8. The portable dance floor defined in claim 1 wherein each element further comprises four elastomeric feet fixed to the lower panel, the element standing via the feet on the ground surface.

9. The portable dance floor defined in claim 8 wherein the feet are in alignment with the four intersections of sticks closest to the corners of the panels.

10. A modular dance-floor system formed of a plurality of identical floor elements each comprising:

a rigid and rectangular upper panel having four straight side edges;

a rigid and rectangular lower panel vertically aligned with and of generally the same dimensions as the upper panel and also having four straight side edges;

a lattice formed of an upper set of parallel sticks and a lower set of parallel sticks perpendicular to the upper sticks and sandwiched between the upper and lower panels, the sticks being longer than the side edges of the panels and having ends projecting therebeyond, the sticks forming with the respective side edges an acute angle whose tangent is equal to the thickness of the sticks measured parallel to the panels divided by the length of the respective side edge.

* * * * *